US006045320A

United States Patent [19]

Cullen

[11] Patent Number: 6,045,320

[45] Date of Patent: Apr. 4, 2000

[54] ARM EXTENSION FOR A BACKHOE

[76] Inventor: Michael J. Cullen, 2773 Wolfberry, NE., Albuquerque, N. Mex. 87122

[21] Appl. No.: 08/992,411

[22] Filed: Dec. 17, 1997

[51] Int. Cl.[7] ..... E02F 9/00

[52] U.S. Cl. ..... 414/724; 212/180; 212/347

[58] Field of Search ..... 414/722, 724; 212/180, 347; 294/67.1, 67.4, 67.41

[56] References Cited

U.S. PATENT DOCUMENTS

| | | | |
|---|---|---|---|
| 1,027,907 | 5/1912 | Sammon | 294/67.41 |
| 2,301,808 | 11/1942 | Mosher . | |
| 2,733,817 | 2/1956 | Couse . | |
| 2,818,981 | 1/1958 | Heimbigner . | |
| 2,938,747 | 5/1960 | Pitts | 294/67.1 |
| 3,092,259 | 6/1963 | Swanson | 414/724 X |
| 3,307,279 | 3/1967 | Tourneau . | |
| 3,460,696 | 8/1969 | Owen, Jr. . | |
| 3,527,362 | 9/1970 | Allen . | |
| 3,587,887 | 6/1971 | DeCarli . | |
| 3,812,979 | 5/1974 | Leihgeber . | |
| 4,159,058 | 6/1979 | Christenson et al. . | |
| 4,200,423 | 4/1980 | Sornsin . | |
| 4,425,072 | 1/1984 | Lewis | 414/724 |
| 4,523,684 | 6/1985 | Baisden . | |
| 4,540,096 | 9/1985 | Orvis | 414/724 X |
| 4,579,504 | 4/1986 | Lemme et al. . | |
| 4,666,049 | 5/1987 | Gilmore, Jr. . | |
| 4,693,384 | 9/1987 | Gilmore, Jr. . | |
| 4,960,359 | 10/1990 | Lovitt, Jr. . | |
| 5,000,269 | 3/1991 | Aoki et al. . | |
| 5,120,186 | 6/1992 | Jorgenson . | |
| 5,140,760 | 8/1992 | Mannbro | 414/722 X |

*Primary Examiner*—Donald W. Underwood

[57] ABSTRACT

An arm attachment for an arm of a backhoe. The arm attachment attaches directly to a shovel to permit large objects to be picked up. A boom includes a support portion resting against the shovel and an extending portion. A cross member extends transversely from the support portion and stabilizers extend from the cross member to the extending portion. A lifting assembly is attached to a free end of the extending portion.

17 Claims, 2 Drawing Sheets

ARM EXTENSION FOR A BACKHOE

RELATED APPLICATION DATA

This application is related to Applicant's copending application Ser. No. 08/866,122, filed on May 30, 1997, the disclosure of which is incorporated herein by reference.

BACKGROUND OF THE INVENTION

1. Field of the Invention

The invention relates to attachments for construction equipment. In particular, the invention is an arm extension that is easily installed on the shovel of a backhoe to extend the reach and functionality of the skiploader arm.

2. Description of the Related Art

In the construction industry, labor and capital equipment costs are the primary variables that affect the cost of a particular project. Of course, in order to remain competitive, a construction contractor must minimize the cost of a project while meeting predetermined specifications. To this end, large machinery has been used to more efficiently handle tasks that were originally accomplished by hand, such as digging, lifting, and moving objects. For example, bulldozers (or graders) have been used to push large amounts of earth for grading and other tasks.

A bulldozer is typically a tractor-like machine having a blade mounted on a frame that extends forward of the tractor body of the bulldozer. The blade is used to push dirt or other objects that need to be moved. The blade can be moved up and down slightly relative to the body to compensate for slopes and other irregularities in the ground. However, a bulldozer is limited to pushing dirt or the like along the ground. In order to lift and move large amounts of dirt or the like, other machinery is necessary. Of course, construction machinery is expensive and is often rented by the hour or by the day. Therefore, limiting the amount of machinery used on a particular project; and making constant use of the available machinery is desirable to limit costs.

In view of this, a device known as a "backhoe" has been developed. A backhoe is a very versatile piece of machinery and thus has become the most widely used piece of construction machinery. A backhoe is capable of doing much of the work of a bulldozer and more. A typical backhoe includes a basic 4-wheel tractor, a front end leader having a pair of extending primary arms mounted to the tractor, a pair of extending secondary arms connected to free ends of the primary arms, and an upwardly directed bucket pivotally mounted on free ends of the secondary arms. Hydraulic cylinders, or the like, are mounted on the various arms and controlled to cause the bucket to be positioned in various desired positions. The bucket can be used to scoop and lift large amounts of dirt or the like.

Additionally a backhoe has a hydraulically controlled digger, known itself as a "backhoe" or a "backhoe digger ", disposed on the tractor at an end opposite to the bucket. Note that the term "backhoe" as used herein refers any construction machine including a tractor and backhoe digger. The backhoe digger loader includes a primary arm pivotally attached to the tractor, a secondary arm pivotally attached to the primary arm, and a downwardly directed shovel disposed on the free end of the secondary arm. The backhoe digger shovel is generally smaller than the front end loader bucket and the arms of the backhoe digger are relatively long to facilitate digging deep holes or reaching high to scoop or dump dirt or the like.

This construction provides a backhoe with the versatility to accomplish a broad range of construction tasks. However, a backhoe does have some limitations. In particular, a conventional backhoe cannot easily lift large relatively fragile objects, such as a stack of plywood or the like. Also, a conventional backhoe has a limited extension and cannot take advantage of the extension of the backhoe digger arms for lifting large objects because of the relatively small size of the backhoe digger shovel. Further, even the extension of the backhoe digger arms, if it could be used for lifting, is often inadequate for picking up and placing large objects.

It is well known to provide attachments to construction machinery. For example, U.S. Pat. No. 4,200,423 issued to Somsin, U.S. Pat. No. 3,812,979 issued to Leihgeber, and U.S. Pat. No. 3,587,887 issued to DeCarli each disclose a boom attachment for front bucket loaders in which a boom is attached to an upwardly directed front bucket. The attachments disclosed by Somsin, Leihgeber, and DeCarli couple to the open face of a front bucket and require a complex rigid attachment to the bucket through bolts or the like. None of Somsin, Leihgeber or DeCarli relate to a backhoe having a backhoe digger and thus the attachments disclosed in these patents are not suitable for mounting on a downwardly directed backhoe digger shovel.

It is also known to provide attachments for a backhoe digger arm. For example, U.S. Pat. No. 4,523,684 issued to Baisden discloses a crane attachment for a backhoe. However, this device requires removal of the skiploader bucket and complex coupling between the hydraulic control system of the backhoe and the crane attachment.

In summary, attempts have been made to increase the versatility of backhoes by providing backhoe digger arm attachments. However, prior inventors have found it necessary to use complex connections which interfere with normal use of the backhoe. Therefore, the prior art attachments introduce limitations.

SUMMARY OF THE INVENTION

It is an object of the invention to overcome the limitations of the prior art discussed above.

It is another object of the invention to increase the versatility of a backhoe.

It is another object of the invention to permit the backhoe digger arm of a backhoe to lift large objects.

It is another object of the invention to attach an arm attachment to a backhoe without significantly modifying the backhoe digger.

It is another object of the invention to allow a single arm attachment configuration to be readily attached to any backhoe digger of any backhoe.

It is another object of the invention to permit an arm attachment to be compact and easily transported to a work site for attachment to a backhoe.

It is yet another object of the invention to permit selective use of an arm attachment of a backhoe digger of a backhoe without the need to remove the backhoe digger shovel.

The objects above are attained by the invention which is an arm attachment for the backhoe digger arm of a backhoe. The arm attachment has a boom formed of an extending portion and a support portion that rests against the shovel of a backhoe digger, a cross member extending from an end of the support portion, and stabilizing members extending from respective ends of the cross member to the extending portion. Tongues are bolted to a lower portion of the backhoe digger shovel and the cross member rests on the tongues. A chain or the like extends from the intersection of the extending portion and the support portion to the shovel pivot member. Hooks or other connecting members can be formed on the extending member to permit objects to be coupled to the extending member for lifting or moving the objects.

BRIEF DESCRIPTION OF THE DRAWINGS

The invention will be described through a preferred embodiment illustrated in the attached drawing in which.

DETAILED DESCRIPTION OF THE PREFERRED EMBODIMENT

Figure 1:
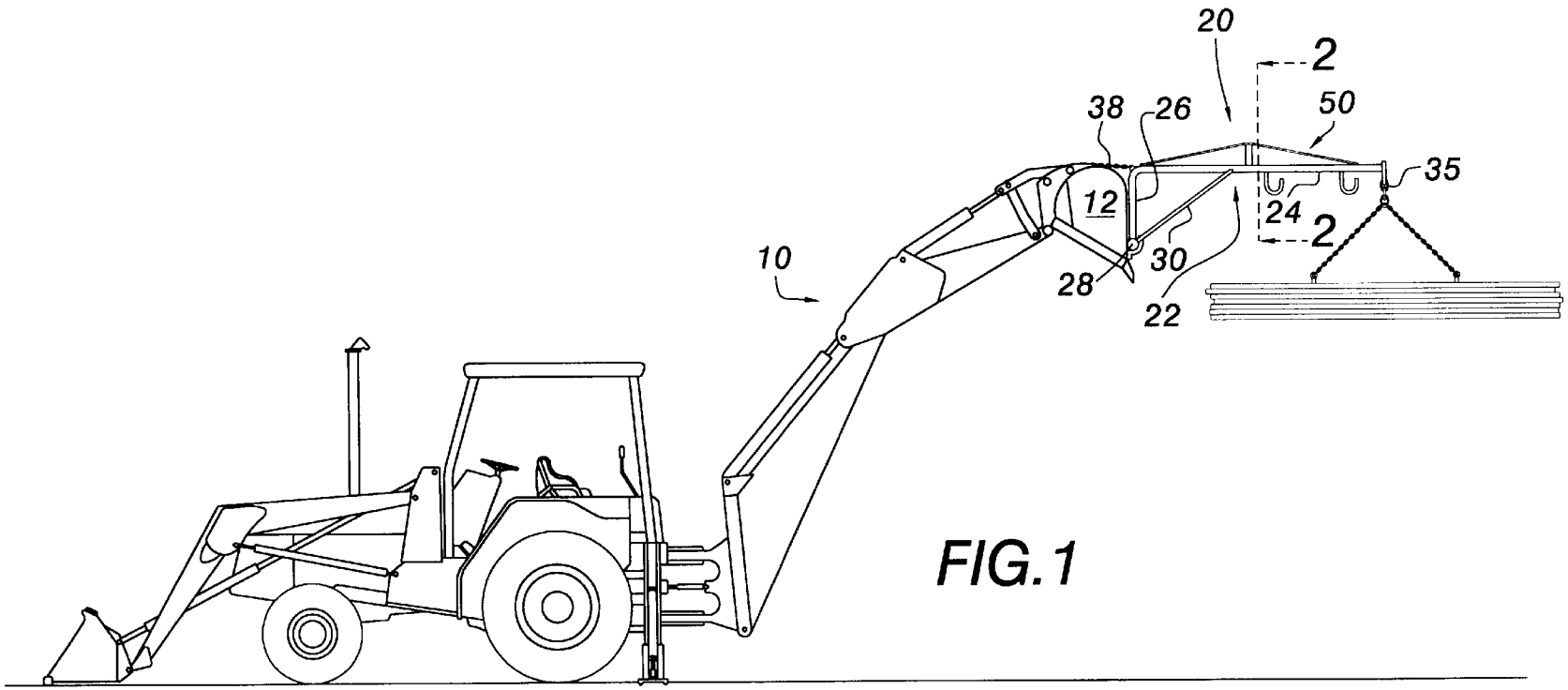
FIG. 1 is a side view of an arm attachment in accordance with the invention on a typical backhoe.

An arm attachment 20 in accordance with the invention is illustrated in FIG. 1 and is shown attached to a conventional backhoe, such as a JD410$_{TM}$ sold by John Deere Co. However, the invention can be adapted to any backhoe. If necessary, the dimensions or configuration of the invention can be changed to accommodate the dimensions of different backhoes. However, since backhoe digger shovels buckets are ordinarily similar in size, one configuration of the invention should be sufficient for most backhoes.

Figure 2:
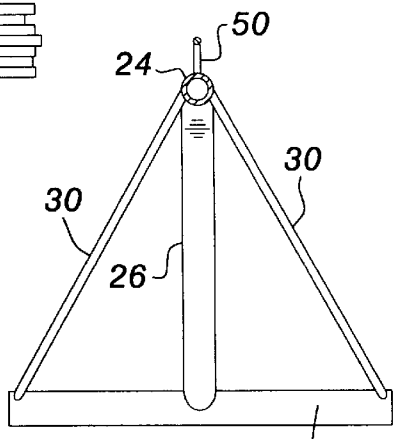
FIG. 2 is a sectional view of the arm attachment of FIG. 1 taken along line 2—2 of FIG. 1.
Figure 3:
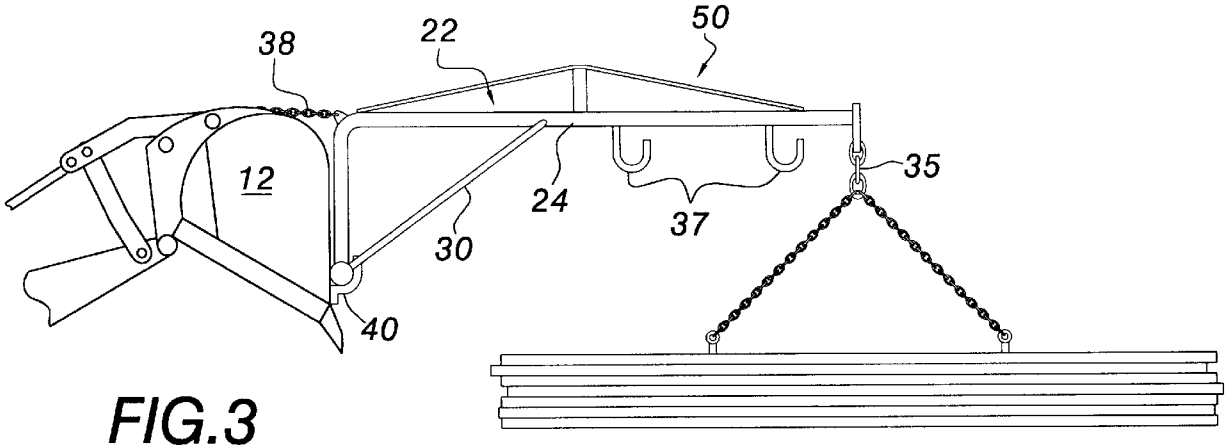
FIG. 3 is a side view of the arm attachment of FIG. 1.

Arm attachment 20 is adapted to be disposed on shovel 12 of backhoe digger 10 of a backhoe, as illustrated in FIG. 1. As illustrated in FIGS. 1–3, arm attachment 20 includes boom 22 having extending portion 24 and support portion 26 extending transversely from an end of extending portion 24. Cross member 28 extends tranversely from a free end of support portion 26. Also, a pair of stabilizing members 30 extend respectively from ends of cross member 28 to extending portion 24. Stabilizing members 30 terminate at a central portion of extending portion 24 in the preferred embodiment. However, stabilizing members 30 can terminate at any appropriate portion of extending portion 24, including the free end of extending portion 24, that provides the desired strength and leverage for the objects to be moved and lifted in the manner described below. Connecting member 35 consisting of a hook, shackle and chain, is disposed at a free end of extending portion 24 for connection to an object to be lifted. Also, hooks 37 can be disposed at various locations along extending portion 24. Of course, connecting member 35 and hooks 37 can be disposed at any appropriate location and can be of any number. Also, these elements can be of any configuration that permits attachment to an article to be lifted.

Tongues 40 are secured to shovel 12 by bolts extending through standard holes preformed on typical shovels. Alternatively, tongues 40 can be welded or otherwise attached to shovel 12 as long as tongue 40 provides a resting surface for receiving cross member 28. Preferably, there are two tongues 40 that are substantially c-shaped or u-shaped to cradle cross member 28 therein. Chain 38, or any other connecting member, extends from an intersection of extending portion 24 and support portion 26 to a pivot support of the shovel. Chain 38 can be attached to the pivot support portion by a hook, shackle or the like, and can be attached to arm attachment 20 by a bolt passed through a hole formed in an ear or the like formed on arm attachment 20 at the appropriate position. Alternatively chain 38 can be attached to any portion of the shovel or associated components of the backhoe digger at one end and to any portion of the arm attachment that is remote from cross member 28 at the other end. This arrangement supports arm attachment 20 from the bottom while allowing arm attachment 20 to pivot slightly about cross member 28 due to vibration or other shock.

Truss or suspension structure 50 can be formed on a top portion of boom 22 to provide additional strength and rigidity if desired. Also, any number of additional stabilizing members or truss structures can be provided to increase strength and rigidity.

Prior to using arm attachment 20, tongues 40 are attached to shovel 12 by bolts, welding or the like. Since conventional shovels have holes formed therein, it is easiest to attach tongues 40 with bolts passed through these existing holes. Also, this facilitates removal of tongues 40 if desired. However, tongues 40 need not be removed for most conventional uses of shovel 12.

With tongues 40 in place, cross member 28 of arm attachment 20 can be set into the saddle formed by tongues 40. Subsequently, chain 38 can be attached to the pivoting support member of skiploader 10 and to boom 22. These two simple procedures constitute the entire attachment of crane attachment 20 to shovel 12.

With arm attachment 20 secured to shovel 12, any object to be lifted, such as stack S of plywood illustrated in FIGS. 1 and 3, can be attached to connecting member 35 or hooks 37 by a chain, cable, or any other means. In this manner, the object to be lifted can be easily lifted merely by controlling the position of shovel 12 of backhoe digger 10. Of course, this can be accomplished with the existing controls of the backhoe in a manner familiar to the backhoe operator. Therefore, no new controls or techniques are required to operate the invention. Note that lag bolts are passed through stock S in the drawings to provide connection to the arm attachment. However, any suitable connection such as chains passed around stacks, can be used.

If extending portion 24 is about 8–9 feet long, the reach of backhoe digger 10 can be typically extended to over 20 feet by the invention. Of course, this length can be adjusted based on the objects to be lifted, the particular backhoe, and the desired reach.

Figure 4:
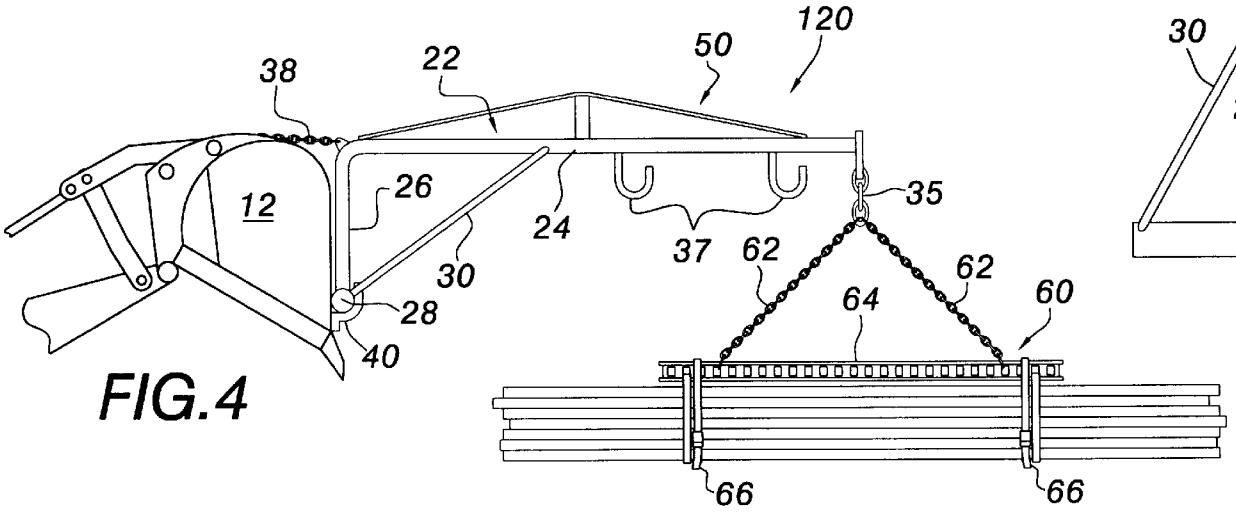
FIG. 4 is a side view of another arm attachment in accordance with the invention.

FIG. 4 illustrates another arm attachment 120 that is similar to the arm attachment of FIGS. 1–3 and like portions thereof have the same reference numerals. However, arm attachment 120 has lifting assembly 60 attached to connecting member 35. Lifting assembly 60 includes bar 64 and connecting segments 62 extending from connecting member 35 to bar 64. Bar 64 has slots formed therein and straps 66, made of nylon or another suitable material, are passed through respective slots. Various objects, such as the illustrated bundle of lumber, can be secured to bar 64 by straps 66. Any type of buckle or adjustment mechanism can be incorporated into straps 66 to permit straps 66 to be tightened around the object to be lifted. Lifting assembly 60 facilitates lifting of objects, particularly long objects. Straps 66 can be passed through different slots depending on the size of the object to be lifted. Also, more than two, or only one, strap can be used. A load can be balanced merely by connecting segments 62 to appropriate slots in the bar with devises or the like.

The various components of the invention can be made of steel tubing, pipe, rods, angle iron, I-beams, or any other materials suited to supporting the loads to be lifted. The arm attachment can be coupled to the shovel in any manner. Further, the structure of the arm attachment can be changed to suit the particular application. For example, the lengths, angles, and quantity of various members can be changed.

Any type of lifting or attachment assembly can be coupled to any portion of the arm attachment to facilitate connection to object to be lifted. Also, objects can be coupled directly to one of the hooks on the arm attachment. The various connecting members, connecting segments and straps can be chains, cables, ropes, fabric straps, or any other suitable material.

It can be seen that the invention provides an arm for a backhoe digger that has few parts, no moving parts, and is easy to assemble and attach. Also, the invention allows the conventional controls of the backhoe to be used for controlling the arm attachment. The shovel of the backhoe digger need not be removed or permanently altered to use the invention. Also, virtually any backhoe can be retrofitted with the invention merely by bolting or welding the tongues to the shovel.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A backhoe and arm attachment combination comprising:

a backhoe including a tractor having a backhoe digger with a shovel;

a boom attached to the backhoe digger shovel; and an attachment device formed on the boom for attaching an object to be lifted to the boom;

wherein said boom comprises a support portion having an elongate cross member adapted to extend transversely along the backhoe digger shovel and to oppose an outer surface of the backhoe digger shovel and an extending portion that extends from said support portion, said attachment device being disposed on said extending portion.

2. A combination as recited in claim 1, wherein said cross member extends from a first end of said support portion and said extending portion extends from a second end of said support portion.

3. An arm attachment as recited in claim 2, further comprising:

a pair of stabilizing members, each of said stabilizing members extending from a respective portion of said cross member to said extending portion.

4. A combination as recited in claim 3, wherein each of said stabilizing members extends from a respective end portion of said cross member to a central portion of said extending portion.

5. An arm attachment for a backhoe digger shovel of a backhoe comprising:

a boom attachable to the backhoe digger shovel; and an attachment device formed on the boom for attaching an object to be lifted to the boom;

wherein said boom comprises a support portion having an elongate cross member adapted to extend transversely along the backhoe digger shovel and to oppose an outer surface of said backhoe digger shovel and an extending portion that extends from said support portion, said attachment device being disposed on said extending portion;

wherein said boom comprises a pipe having a bent portion of about a 90° angle to define said extending portion and said support portion on respective sides of said bent portion.

6. A combination as defined in claim 3, further comprising:

a truss structure disposed on said extending portion.

7. A combination as recited in claim 3, further comprising:

a plurality of hooks formed on said extending portion.

8. An arm attachment as recited in claim 3, further comprising:

a connecting member extending from said boom and being adapted to connection with a backhoe digger.

9. A backhoe and arm attachment combination comprising:

a backhoe including a tractor having a backhoe digger mounted thereon;

at least one tongue disposed on an outer surface of a shovel of said backhoe digger;

an elongate cross member supported by said at least one tongue to oppose the outer surface;

a boom comprising a support portion extending from said cross member and, an extending portion extending from said support portion at about a 90° angle therefrom.

10. A combination as recited in claim 9, further comprising:

a pair of stabilizing members, each of said stabilizing members extending from a respective portion of said cross member to said extending portion.

11. A combination as recited in claim 10, wherein each of said stabilizing members extends from a respective end portion of said cross member to a central portion of said extending portion.

12. A backhoe and arm attachment combination comprising:

a backhoe including a tractor having a backhoe digger mounted thereon;

at least one tongue disposed on an outer surface of a shovel of said backhoe digger;

an elongate cross member supported by said at least one tongue to oppose the outer surface;

a boom comprising a support portion extending from said cross member and an extending portion extending from said support portion;

wherein said boom comprises a pipe having a bent portion of about a 90° angle to define said extending portion and said support portion on respective sides of said bent portion.

13. A combination as defined in claim 9, further comprising:

a truss structure disposed on said extending portion.

14. A combination as recited in claim 9, further comprising:

a plurality of hooks formed on said extending portion.

15. A combination as recited in claim 8, further comprising:

a lifting assembly coupled to said connecting member, said lifting assembly comprising a pair of connecting segments coupled to said connecting member, a bar having slots formed therein coupled to said connecting segments, and a pair of straps passed through respective ones of said slots and adapted to couple an object to said bar.

16. An arm attachment for a backhoe digger shovel of a backhoe comprising:

a boom that is attachable to the backhoe digger shovel, said boom comprising a cross member and a pipe extending from said cross member and having a bent portion of about a 90° angle to define a support portion adapted to rest against said backhoe digger shovel on one side of said bent portion and an extending portion on the other side of said bent portion; and an attachment device disposed on said extending portion of said boom for attaching an object to be lifted to said boom.

17. A backhoe and arm attachment combination comprising:

a backhoe including a tractor having a backhoe digger mounted thereon;

at least one tongue disposed on a shovel of said backhoe digger;

a cross member supported by said at least one tongue;

a boom comprising a support portion extending from said cross member, a bent portion of about a 90° angle, and an extending portion, said extending portion and said support portion being disposed on respective sides of said bent portion.

* * * * *